US006694930B2

(12) United States Patent
Berlinger et al.

(10) Patent No.: US 6,694,930 B2
(45) Date of Patent: Feb. 24, 2004

(54) PISTON ASSEMBLY FOR USE IN A FREE PISTON INTERNAL COMBUSTION ENGINE

(75) Inventors: Willibald G. Berlinger, Peoria, IL (US); William E. Moser, Peoria, IL (US); Cornelius N. Opris, Peoria, IL (US); Christopher G. Wark, Peoria, IL (US); Leland W. Weiss, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 122 days.

(21) Appl. No.: 09/970,599

(22) Filed: Oct. 4, 2001

(65) Prior Publication Data

US 2003/0066499 A1 Apr. 10, 2003

(51) Int. Cl.[7] ..... F02B 71/00

(52) U.S. Cl. ..... 123/46 R; 123/41.33; 123/41.35

(58) Field of Search ..... 123/46 R, 46 A, 123/46 B, 46 SC, 46 E, 46 H, 41.33, 41.35

(56) References Cited

U.S. PATENT DOCUMENTS 3,145,660 A 8/1964 Bush
4,415,313 A 11/1983 Bouthors et al.
4,653,273 A 3/1987 David
4,662,177 A * 5/1987 David ..... 123/46 B
4,803,960 A 2/1989 Koppen
6,105,541 A 8/2000 Berlinger ..... 123/46 R
6,463,903 B1 * 10/2002 Berlinger et al. ..... 123/193.6

OTHER PUBLICATIONS

Ronnie Werndin, Peter Achten, Mikael Sannelius and Jan Ove Palmberg, Efficiency Performance and Control Aspects of a Hydraulic Transformer, The Sixth Scandinavian International Conference on Fluid Power, SICFP '99, May 26–28, 1999, Tampere, Finland, pp. 395–407.

* cited by examiner

*Primary Examiner*—Marguerite McMahon
(74) *Attorney, Agent, or Firm*—Todd T Taylor

(57) ABSTRACT

A piston assembly, particularly suitable for use in a free piston internal combustion engine, is provided with a piston including at least one oil coolant passage therein. The plunger shaft is substantially rigidly attached to the piston and axially extends from the piston. The plunger shaft includes at least one oil supply passage fluidly connected with at least one oil coolant passage.

25 Claims, 5 Drawing Sheets

PISTON ASSEMBLY FOR USE IN A FREE PISTON INTERNAL COMBUSTION ENGINE

TECHNICAL FIELD

The present invention relates to free piston internal combustion engines, and, more particularly, to piston assemblies in a free piston internal combustion engine.

BACKGROUND

Free piston internal combustion engines include one or more pistons which are reciprocally disposed within corresponding combustion cylinders. However, the pistons are not interconnected with each other through the use of a crankshaft. Rather, each piston is typically rigidly connected with a plunger shaft which is used to provide some type of work output. For example, the plunger shaft may be used to provide electrical power output by inducing an electrical current, or fluid power output such as pneumatic or hydraulic power output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter, the compression cylinder has an inside diameter which is smaller than the combustion cylinder; and the hydraulic cylinder has an inside diameter which is still yet smaller than the compression cylinder. A compression head which is attached to and carried by the plunger shaft at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center (TDC) position.

Pistons used in free piston internal combustion engines typically include a piston head which is entirely constructed from a metallic material such as aluminum or steel. Metals such as aluminum and steel have a relatively high coefficient of thermal expansion. Thus, during operation of the free piston engine, the metallic piston head expands considerably in the radial direction toward the inside surface of the combustion cylinder. Each piston head used in the free piston engine is thus formed with an outside diameter which provides a considerable radial clearance with the inside surface of the combustion cylinder to accommodate the relatively large radial expansion during operation. To prevent blow-by of combustion products past the piston head during operation, the outside peripheral surface of the piston head is formed with one or more piston ring grooves which receive corresponding piston rings therein. The piston rings allow for radial thermal expansion and contraction of the piston head, while at the same time effectively preventing blow-by of combustion products past the piston head.

A problem with using conventional piston and cylinder arrangements is that suitable fluid cooling channels must be provided within the combustion cylinder to effect the proper cooling of the combustion cylinder and piston head. These cooling fluid channels increase the size and complexity of the engine. Moreover, the sliding interface between the piston and cylinder may not provide adequate cooling of the piston.

An example of a piston used in a free piston internal combustion engine is disclosed in U.S. Pat. No. 6,105,541 (Berlinger), assigned to the assignee of the present invention.

The present invention is directed to overcoming one or more of the problems as set forth above.

SUMMARY OF THE INVENTION

In one aspect of the invention, a free piston internal combustion engine includes a combustion cylinder. A piston is reciprocally disposed within the combustion cylinder. The piston includes at least one oil coolant passage therein. The plunger shaft is attached to the piston and slidably disposed within a hydraulic cylinder. The plunger shaft includes at least one oil supply passage fluidly interconnecting the hydraulic cylinder and at least one oil coolant passage In another aspect of the invention, a piston assembly for use in a free piston internal combustion engine is provided with a piston including at least one oil coolant passage therein. The plunger shaft is substantially rigidly attached to the piston and axially extends from the piston. The plunger shaft includes at least one oil supply passage fluidly connected with at least one oil coolant passage.

DETAILED DESCRIPTION

Figure 1:
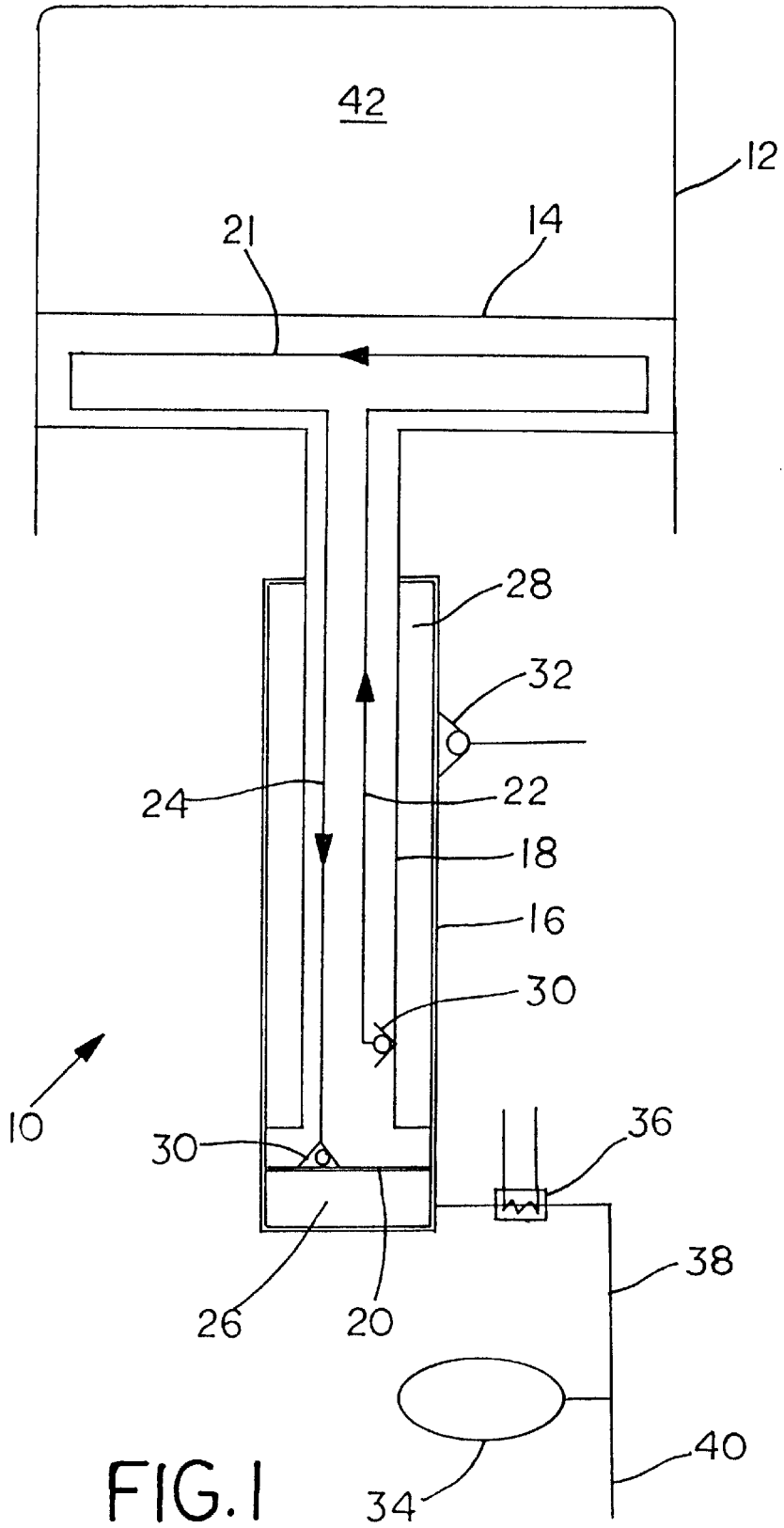
FIG. 1 is a schematic view of a free piston internal combustion engine of the present invention.

Referring now to the drawings, and more particularly to FIG. 1, there is shown an embodiment of a free piston internal combustion engine 10 of the present invention. Free piston internal combustion engine 10 generally includes a combustion cylinder 12, piston 14, hydraulic cylinder 16 and plunger shaft 18.

Free piston engine 10 likely includes a plurality of combustion cylinders 12; however, only a single combustion cylinder 12 is shown in FIG. 1 for simplicity sake. Combustion cylinder 12 receives a fuel and air mixture therein which is used during the combustion process to move piston 14 and plunger shaft 18 to a bottom dead center position. In the embodiment shown, it is the assumed that a diesel fuel and air mixture is injected into combustion cylinder 12, which thus operates on the diesel principle of operation.

Piston 14 is reciprocally disposed within combustion cylinder 12 and moved from a bottom dead center position to a top dead center position, and vice versa, during operation. Piston 14 includes at least one oil coolant passage 21 therein which allows hydraulic oil to be transported through piston 14 for the purpose of cooling piston 14 during operation.

Hydraulic plunger shaft 18 is substantially rigidly attached to piston 14 and slidably disposed within hydraulic cylinder 16. Plunger shaft 18 includes a plunger head 20 at an end opposite from piston 14. Plunger head 20 has an outside diameter which is approximately the same as the inside diameter of hydraulic cylinder 16, notwithstanding some clearance distance therebetween. Plunger shaft 18 is generally coaxially coupled with piston 14 and reciprocates in a coaxial manner with piston 14 in combustion cylinder 12 during operation.

Plunger shaft 18 also includes an oil supply passage 22 and an oil return passage 24. Each of oil supply passage 22 and oil return passage 24 are fluidly coupled with at least one oil coolant passage 21 within piston 14 to effect a directional flow of the coolant oil through piston 14 for the purpose of cooling piston 14. Oil supply passage 22 has an opposite end which is fluidly coupled with chamber 26 within hydraulic cylinder 16 on a side of plunger head 20 opposite from piston 14. Oil return passage 24 has an opposite end which is fluidly coupled with chamber 28 within hydraulic cylinder 16 on a side of plunger head 20 adjacent to piston 14. Oil supply passage 22 and oil return passage 24 each include a check valve 30 which allow flow of the coolant oil in a single direction through piston 14. This effects the pumping action of the hydraulic oil through piston 14, as will be described in more detail here in after. An additional check valve 32 fluidly coupled with a side wall of hydraulic cylinder 16 is aligned in flow direction with check valve 30 of oil supply passage 22. An opposite end of check valve 32 is fluidly coupled with a low pressure accumulator (not shown).

Chamber 26 within hydraulic cylinder 16 is fluidly coupled with a high pressure accumulator 34. High pressure accumulator 34 includes a supply of high pressure hydraulic oil therein, which is provided in a pulsed manner to chamber 26 to drive plunger shaft 18 and piston 14 to a top dead center position within combustion cylinder 12. A heat exchanger 36 positioned in fluid association with fluid line 38 cools hydraulic oil transported from chamber 26 which may have absorbed heat as a result of being used as a cooling agent to cool piston 14. An output end 40 of fluid line 38 is fluidly coupled with one or more working loads driven by high pressure hydraulic oil within high pressure accumulator 34. For example, the working loads (not shown) may be in the form of a hydraulic drive or hydrostatic transmission in a work machine.

Figure 2:
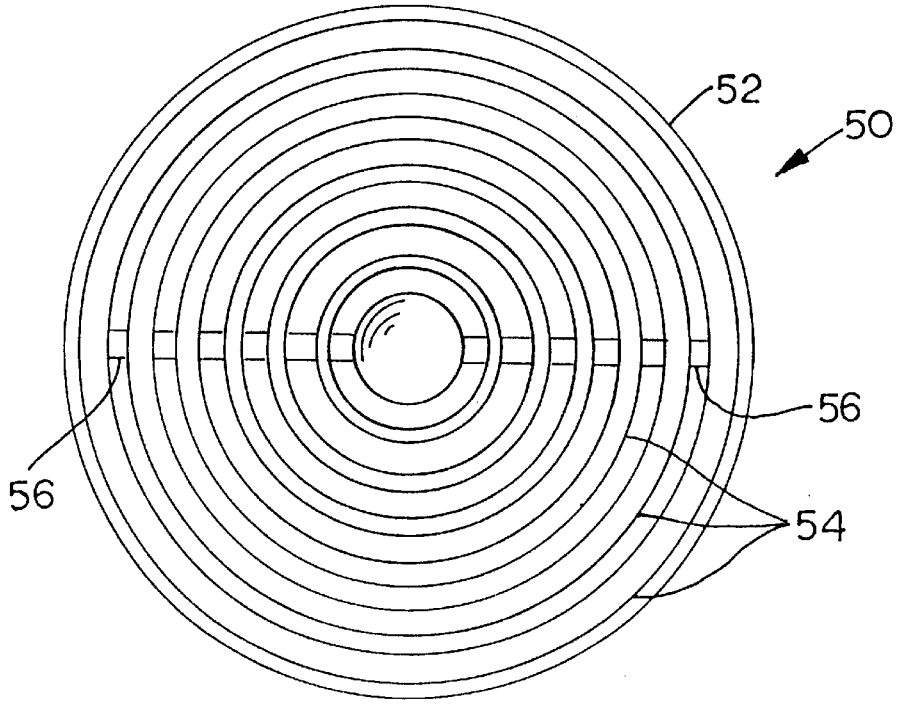
FIG. 2 is a top view of an embodiment of a piston assembly of the present invention.

Referring now to FIG. 2, there is shown a simplified, top view of another embodiment of a piston 50 of the present invention. Piston 50 is rigidly coupled with a plunger shaft (not shown). Piston 50 includes a crown 52 with a plurality of annular oil coolant passages 54 therein. Oil coolant passages 54 are positioned radially adjacent to and generally concentric to each other within crown 52. Oil coolant passages 54 are fluidly connected to each other by radially extending passages 56. Oil coolant passages 54 and radially extending passages 56 are fluidly coupled with at least one oil supply passage within the plunger shaft coupled with piston 50. Oil coolant passages 54 and radially extending passages 56 are also fluidly coupled with an oil return passage, such as an oil return passage within the plunger shaft. Alternatively, the oil return passage may be in the form of an axially extending fluid line which moves in reciprocating manner with piston 50. A check valve may of course be provided with the oil supply passage and oil return passage to effect one-way flow of coolant oil through piston 50.

Figure 3:
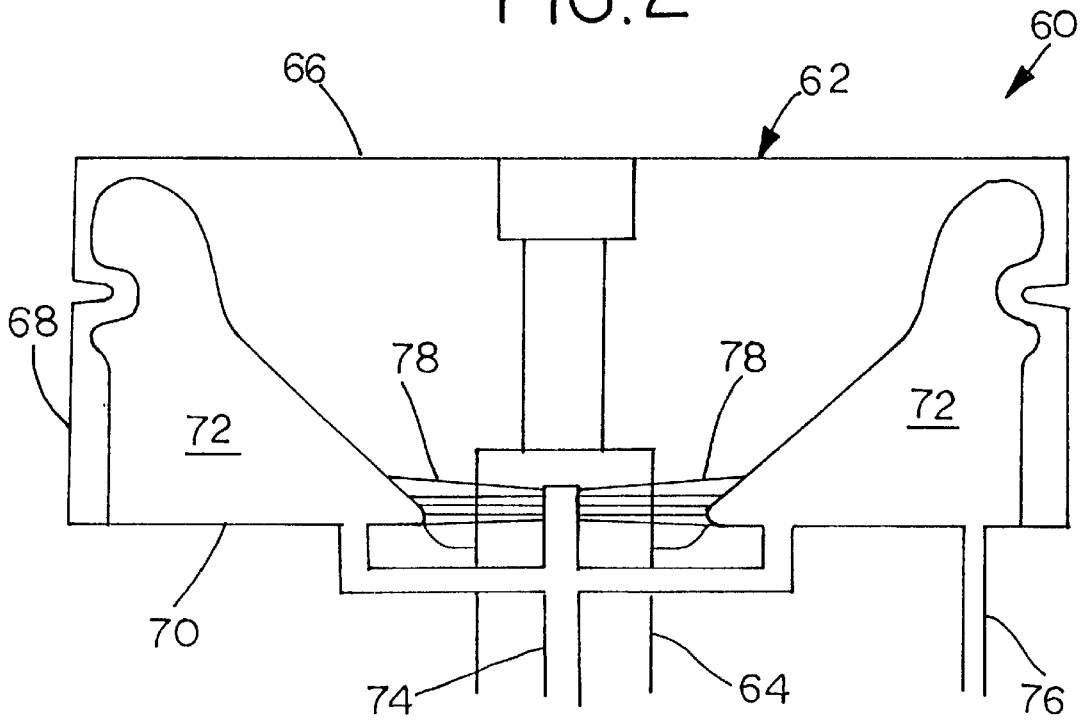
FIG. 3 is a fragmentary, side sectional view of another embodiment of a piston assembly of the present invention.

Referring now to FIG. 3, there is shown another embodiment of a piston assembly 60 of the present invention, including a piston 62 and plunger shaft 64. Piston 62 includes a crown 66, skirt 68 and rear cover 70 which together define a coolant oil chamber 72 adjacent to crown 66. Coolant oil chamber 72 is generally annularly shaped around plunger shaft 64. Coolant oil chamber 72 receives hydraulic oil from oil supply passage 74 in plunger shaft 64, and discharges the hydraulic oil to an oil return passage 76 configured as a fluid line which reciprocatingly moves with piston assembly 60. To ensure uniform flow of the hydraulic oil within coolant oil chamber 72 and avoid hot spots within coolant oil chamber 72, a plurality of radially extending jet apertures 78 discharge hydraulic oil at a higher velocity into coolant oil chamber 72.

Figure 4:
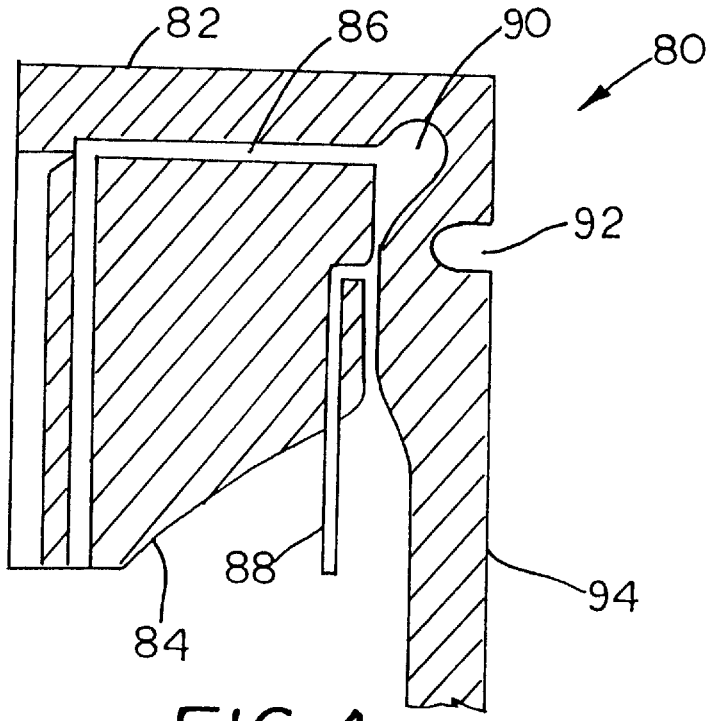
FIG. 4 is a fragmentary, side sectional view of yet another embodiment of a piston assembly of the present invention.

FIG. 4 is a fragmentary, sectional view of another environment of a piston 80 of the present invention which may be utilized in a piston assembly including a plunger shaft. Piston 80 includes a crown 82 and a support block 84 positioned adjacent crown 82. Support block 84 provides the dual functionality of both structurally supporting piston 80 during use, as well as defining one or more oil coolant passages 86 together with crown 82. Oil coolant passage 86 receives a flow of hydraulic oil from an attached plunger shaft, and discharges the hydraulic oil through the oil return passage 88. Oil coolant passage 86 defines a thinned area 90 between crown 82 and a piston ring groove 92 for inhibiting heat transfer to a piston skirt 94 adjacent piston ring groove 92.

Figure 5:
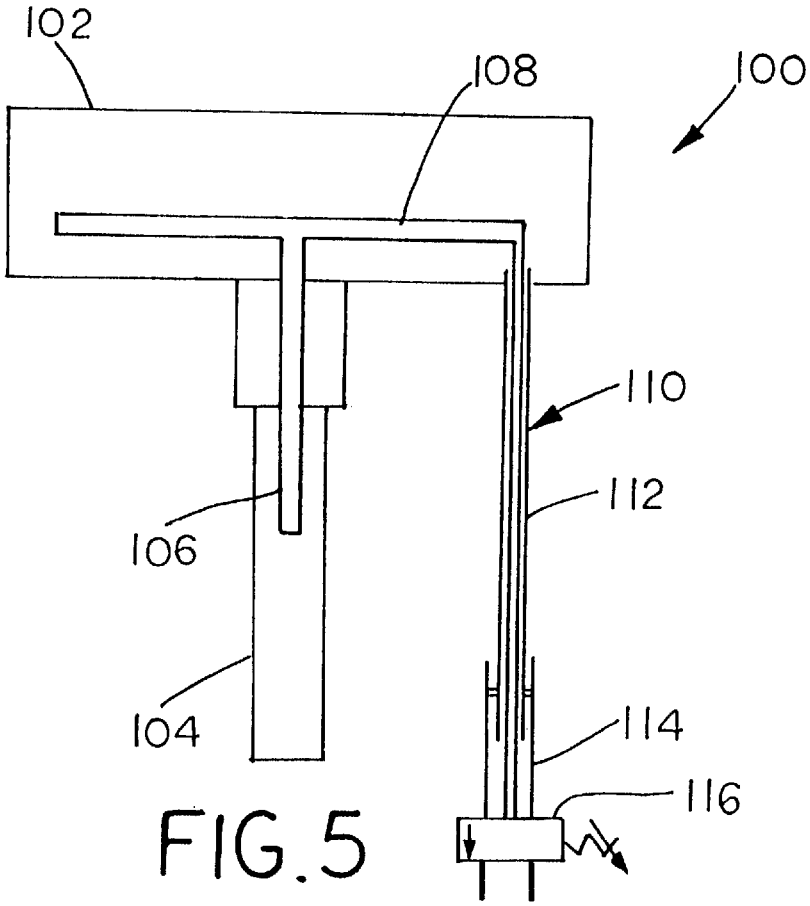
FIG. 5 is a schematic, side view of yet another embodiment of a piston assembly of the present invention.

FIG. 5 is a schematic view of another embodiment of a piston assembly 100 of the present invention, including a piston 102 and plunger shaft 104. Plunger shaft 104 includes and oil supply passage 106 providing hydraulic oil to one or more oil coolant passages 108 within piston 102. FIG. 5 principally illustrates the structure of an oil return passage 110 coupled with oil coolant passages 108. Oil return passage 110 includes a first fluid line 112 and second fluid line 114 which are free to reciprocate relative to each other in a sealed manner. Thus, first fluid line 112 moves in a reciprocating manner with piston 102 and plunger shaft 104 during operation. A variable restriction 116 in the form of a variably controllable valve allows the flow of hydraulic oil to piston assembly 100 to be controlled.

For example, piston assembly 100 may become hotter under high load operating conditions, and thus require maximum coolant flow through piston 102. Moreover, the work load conditions under which the hydraulic oil is outputted from the free piston engine to a work unit may be at a high level such that temporary halting or reduction in fluid flow through piston 102 is desirable.

Figure 6:
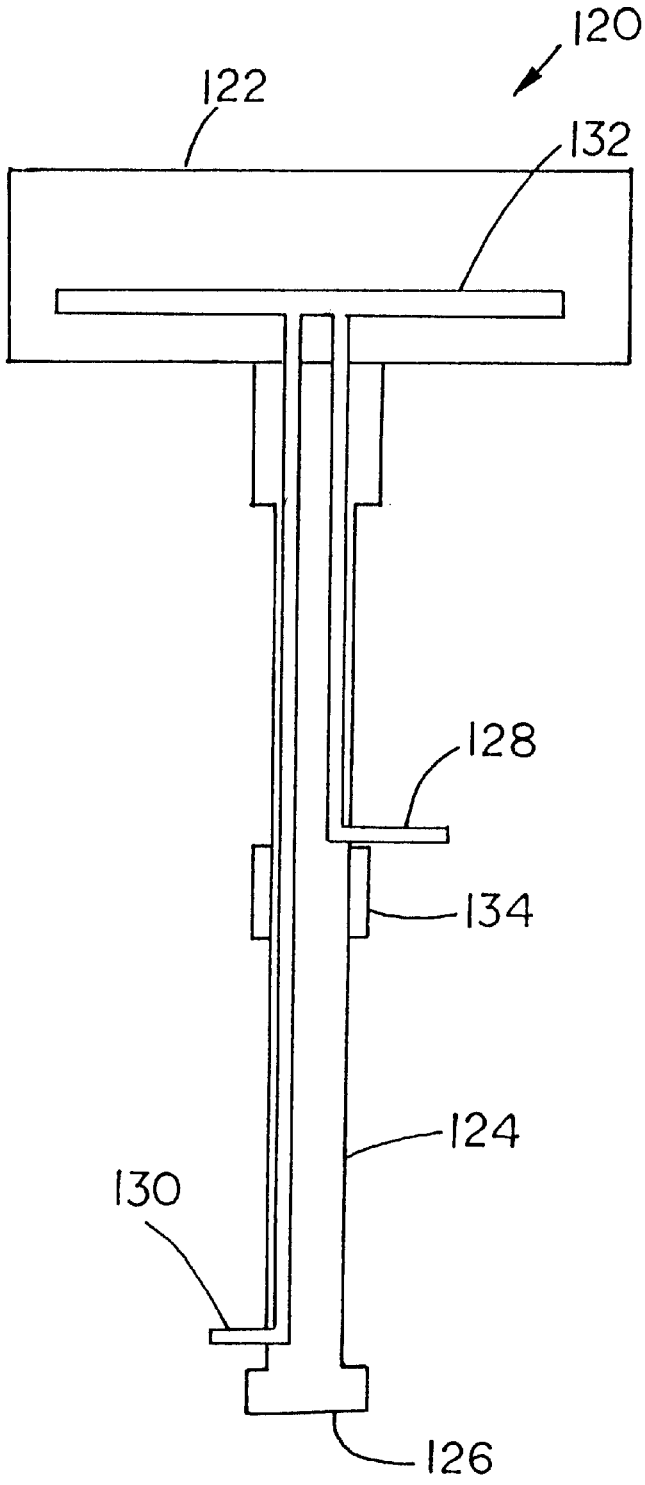
FIG. 6 is a schematic, side view of a further embodiment of a piston assembly of the present invention.

FIG. 6. Illustrates another embodiment of a piston assembly 120 of the present invention, including a piston 122 and plunger shaft 124. Plunger shaft 124 includes a plunger head 126, oil supply passage 128 and oil return passage 130. However, in contrast with the embodiment shown in FIG. 1, oil supply passage 128 and oil return passage 130 each include an open end opposite from the connection location with oil coolant passage 132 which terminates on the same side of plunger head 126 (i.e., on the side of plunger head 126 adjacent to piston 122). To maintain fluidly sealed separation between oil supply passage 128 and oil return passage 130, the housing of the free piston internal combustion (not shown) includes one or more seals 134 which fluidly separate oil supply passage 128 from oil return passage 130. Regardless of whether piston assembly 120 is at the top dead center position or the bottom dead center position, or some position therebetween, seal 134 fluidly separates oil supply passage 128 from oil return passage 130.

Figure 7:
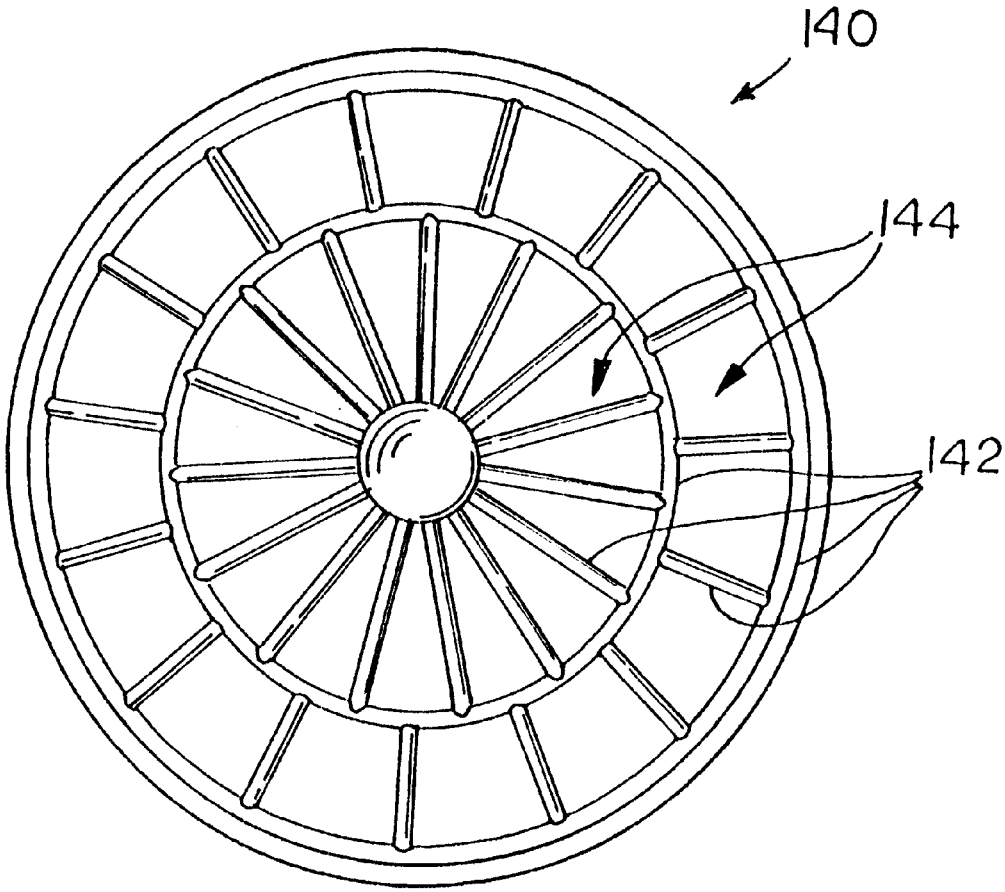
FIG. 7 is a top view of yet another embodiment of a piston assembly of the present invention.

Referring to FIG. 7, there is shown another embodiment of a piston 140 which may be incorporated in a piston assembly of the present invention. Piston 140 includes a plurality of oil coolant passages 142 which are configured in a spoke pattern for cooling pistons 140. More particularly, piston 140 includes a plurality of radially adjacent rows of oil coolant passages 144, with each each row 144 including a plurality of radially extending oil coolant passages 142. The radially extending oil coolant passages 142 in one row 144 are non-aligned relative to oil coolant passages 142 in an adjacent row. This causes the hydraulic oil to circuitously flow through piston 140, and thereby assisting in cooling piston 140.

Industrial Applicability

During use, a diesel and air mixture is injected into combustion cylinder 12 within combustion chamber 42. High pressure accumulator 34 is supplied with high pressure hydraulic oil therein, and a pulse of the high pressure hydraulic oil is transported through fluid line 38 to chamber 26 within hydraulic cylinder 16. The high pressure hydraulic oil exerts an axial force against plunger head 20 which drives plunger shaft 18 and piston 14 toward a top dead center position. As piston 14 travels towards the top dead center position, hydraulic oil within chamber 28 cannot flow through check valve 32, and thus flows through check valve 30 associated with supply line 22. As piston 14 travels toward the top dead center position, the volume within chamber 28 decreases which causes the hydraulic oil therein to be pumped through oil supply passage 22 and oil coolant passage 21. The oil cools piston head 14 and flows through oil return passage 24 toward chamber 26. Check valve 30 is configured to allow flow of the hydraulic oil into chamber 26.

As piston 14 is at or near the top dead center position, combustion of the diesel and air mixture occurs through compression energy applied to the fuel and or mixture. Piston 14 and plunger shaft 18 are thus driven by the combustion force toward the bottom dead center position at or near the position of piston 14 shown in FIG. 1. Because of the nature of operation of free piston engine 10, the exact top dead center position and bottom dead center position can in fact vary from one combustion cycle to another.

During the return stoke towards the bottom dead center position, check valve 30 of oil return passage 24 closes which in turn causes compression of the hydraulic oil within chamber 26. The compressed hydraulic oil is then pumped through fluid line 38 to high pressure hydraulic accumulator 34 to regenerate high pressure accumulator 34. Heat exchanger 36 cools the hydraulic oil which is supplied to high pressure accumulator 34. Additionally, during the return stroke of piston 14 and plunger shaft 18, the volume within chamber 28 expands which causes the pressure to correspondingly decrease. Hydraulic oil flows through check valve 32 into chamber 28 as a result of the volume expansion and pressure decrease. Hydraulic oil is thus present within chamber 28 for the next pumping action of the oil through piston 14 which occurs in the next compression stoke as piston 14 moves toward the top dead center position.

The present invention provides a piston assembly for use in a free piston internal combustion engine which utilizes the hydraulic oil in the hydraulic cylinder of the free piston engine to cool the piston assembly during use. Existing components such as the piston and plunger shaft may be advantageously used to carry the hydraulic oil from the piston for the purpose of cooling the piston during operation. A separate oil return passage in the form of a return line which reciprocatingly moves with the piston may be utilized, but is not required. The flow of hydraulic oil may be controlled by providing a controllable variable restriction so that cooling may be temporarily suspended, dependent upon operating requirements and/or work load requirements. Additionally, the hydraulic oil may be cooled after absorbing heat from the piston so that additional energy is not added to the hydraulic oil provided to the work units Other aspects, objects and advantages of this invention can be obtained from a study of the drawings, the disclosure and the appended claims.

What is claimed is:

1. A free piston internal combustion engine, comprising:

a combustion cylinder;

a piston reciprocally disposed within said combustion cylinder, said piston including at least one oil coolant passage therein;

a hydraulic cylinder;

a plunger shaft attached to said piston and slidably disposed within said hydraulic cylinder, said plunger shaft including at least one oil supply passage fluidly interconnecting said hydraulic cylinder and said at least one oil coolant passage and an oil return passage fluidly coupled with said at least one oil coolant passage; and a heat exchanger fluidly coupled with said oil return passage.

2. The free piston internal combustion engine of claim 1, including at least one check valve associated with said at least one oil supply passage, each said check valve being openable and closable upon slidable movement of said plunger shaft.

3. The free piston internal combustion engine of claim 1, said piston including a crown, said at least one oil coolant passage including a plurality of oil coolant passages in said crown.

4. The free piston internal combustion engine of claim 3, said plurality of oil coolant passages configured in a spoke pattern.

5. The free piston internal combustion engine of claim 3, said oil coolant passages including a plurality of radially adjacent rows of oil passages, each said row including a plurality of radially extending oil coolant passages, said oil coolant passages of one said row being non-aligned relative to said oil coolant passages of another said row.

6. The free piston internal combustion engine of claim 1, said piston including a crown, said at least one oil coolant passage including a coolant oil chamber adjacent said crown.

7. The free piston internal combustion engine of claim 6, said coolant oil chamber having an annular shape around said plunger shaft.

8. The free piston internal combustion engine of claim 1, said piston including a crown, said at least one oil coolant passage including a plurality of annular oil coolant passages positioned radially adjacent to each other and fluidly connected to each other.

9. The free piston internal combustion engine of claim 1, said piston having a crown, and including a support block adjacent said crown, at least one of said crown and said support block defining said at least one oil coolant passage.

10. The free piston internal combustion engine of claim 9, said crown and said support block defining said at least one oil coolant passage there between.

11. The free piston internal combustion engine of claim 1, including a variable restriction associated with said at least one oil coolant passage.

12. The free piston internal combustion engine of claim 11, including an oil return passage fluidly coupled with said at least one oil coolant passage, said variable restriction positioned in association with said oil return passage.

13. A piston assembly for use in a free piston internal combustion engine, comprising:

a piston including at least one oil coolant passage therein; and a plunger shaft substantially rigidly attached to said piston and axially extending from said piston, said plunger shaft including at least one oil supply passage fluidly connected with said at least one oil coolant passage; and a heat exchanger fluidly coupled with said oil supply passage.

14. The piston assembly of claim 13, said piston including a crown, said at least one oil coolant passage including a plurality of oil coolant passages in said crown.

15. The piston assembly of claim 14, said plurality of oil coolant passages configured in a spoke pattern.

16. The piston assembly of claim 14, said oil coolant passages including a plurality of radially adjacent rows of oil passages, each said row including a plurality of radially extending oil coolant passages, said oil coolant passages of one said row being non-aligned relative to said oil coolant passages of another said row.

17. The piston assembly of claim 13, said piston including a crown, said at least one oil coolant passage including a coolant oil chamber adjacent said crown.

18. The piston assembly of claim 17, said coolant oil chamber having an annular shape around said plunger shaft.

19. The piston assembly of claim 13, said piston including a crown, said at least one oil coolant passage including a plurality of annular oil coolant passages positioned radially adjacent to each other and fluidly connected to each other.

20. The piston assembly of claim 13, said piston having a crown, and including a support block adjacent said crown, at least one of said crown and said support block defining said at least one oil coolant passage.

21. The piston assembly of claim 20, said crown and said support block defining said at least one oil coolant passage therebetween.

22. The piston assembly of claim 13, said plunger shaft including an oil return passage fluidly coupled with said at least one oil coolant passage.

23. A method of operating a free piston internal combustion engine, comprising the steps of:

providing a piston assembly including a piston and a plunger shaft, said piston including at least one oil coolant passage therein, said plunger shaft including at least one oil supply passage fluidly connected with said at least one oil coolant passage;

reciprocating said plunger shaft within a hydraulic cylinder;

circulating hydraulic oil within said hydraulic cylinder through said at least one oil supply passage and said at least one oil coolant passage as a result of said reciprocating step; and cooling said hydraulic oil with a heat exchanger fluidly coupled with said oil coolant passage.

24. The method of claim 23, including the step of controlling a flow amount of said hydraulic oil during said circulating step using a variable restriction associated with said at least one oil coolant passage.

25. The method of claim 23, including the steps of:

positioning at least one check valve in association with said at least one oil supply passage; and opening and closing each said check valve dependent upon said reciprocating step.

* * * * *